US010486077B2

(12) United States Patent
Gulick et al.

(10) Patent No.: US 10,486,077 B2
(45) Date of Patent: Nov. 26, 2019

(54) TOY ASSEMBLY FOR RETAINING AND LAUNCHING MINIATURE BOOMERANGS

(71) Applicants: Matthew Gulick, Bluffton, SC (US); Sean Babb, Gorham, ME (US)

(72) Inventors: Matthew Gulick, Bluffton, SC (US); Sean Babb, Gorham, ME (US)

( * ) Notice: Subject to any disclaimer, the term of this patent is extended or adjusted under 35 U.S.C. 154(b) by 0 days.

(21) Appl. No.: 16/236,684

(22) Filed: Dec. 31, 2018

(65) Prior Publication Data

US 2019/0224583 A1 Jul. 25, 2019

Related U.S. Application Data

(60) Provisional application No. 62/620,755, filed on Jan. 23, 2018.

(51) Int. Cl.

| | |
|---|---|
| ***A63H 33/18*** | (2006.01) |
| ***F41B 3/00*** | (2006.01) |
| ***A63B 65/08*** | (2006.01) |
| ***A63H 27/14*** | (2006.01) |

(52) U.S. Cl.

CPC ..... *A63H 33/18* (2013.01); *A63B 65/08* (2013.01); *A63H 27/14* (2013.01); *F41B 3/00* (2013.01)

(58) Field of Classification Search

CPC ..... A63B 65/08; A63H 27/14; A63H 33/18; F41B 3/00

See application file for complete search history.

(56) References Cited

U.S. PATENT DOCUMENTS

| | | | | |
|---|---|---|---|---|
| 2,663,119 A * | 12/1953 | Pierce | A63H 27/14 446/45 |
| 2,837,077 A * | 6/1958 | Frazelle | A63H 27/14 124/16 |
| 3,881,729 A * | 5/1975 | Block | A63B 65/08 473/590 |
| 6,416,378 B2 * | 7/2002 | Yurkoski | A63H 33/18 446/34 |
| 6,505,618 B1 * | 1/2003 | Ben-Hador | A63B 65/08 124/16 |
| 8,978,633 B2 * | 3/2015 | Hedeen, Jr. | A63H 27/00 124/16 |
| 2015/0128925 A1 * | 5/2015 | Platt | A63H 33/18 124/79 |

* cited by examiner

*Primary Examiner* — John A Ricci
(74) *Attorney, Agent, or Firm* — John M Brandt

(57) ABSTRACT

A toy assembly for retaining and launching a miniature boomerang from an upper limb of the body which limb includes a wrist, hand and fingers, the assembly consisting of the combination of the boomerang, a support member attachable to the upper limb, and a platform mounted on top of the support member to retain the boomerang in a first storage position and further to provide for the shifting of the boomerang to a second launching position wherein launching is accomplished by flicking a wing of the boomerang with a finger of the opposite upper limb on which the support member is positioned.

10 Claims, 7 Drawing Sheets

TOY ASSEMBLY FOR RETAINING AND LAUNCHING MINIATURE BOOMERANGS

CROSS REFERENCE TO RELATED APPLICATIONS

This application is based on the disclosure of U.S. Provisional Application No. 62/620,755 filed Jan. 18, 2018 by the same inventors which disclosure is herein incorporated by reference.

BACKGROUND OF THE INVENTION

Field of the Invention

The invention resides in the field of toys and more particularly relates to a device for holding and launching a miniature boomerang.

Description of the Prior Art

The prior art discloses a number of toy assemblies arranged to launch a miniature boomerang or disk. As best known to applicants, most if not all of these devices are hand held pistol style structures which operate by complex combinations of parts designed to store multiple launchable units, provide a launching force using springs, and to further function by employing various interlocking connection and linking mechanisms which operate by, for example, pulling a trigger.

Representative US patents include U.S. Pat. No. 4,372,281, Fiorini; U.S. Pat. No. 5,996,564; Kotowski; U.S. Pat. No. 6,733,356, Lee; and U.S. Pat. No. 8,978,633, Hedeen, Jr.

In contrast to the prior art, applicants' invention presents a compact structure of small size, easily carried in a pocket, and in use is worn as a ring on a finger or a bracelet band or similar structure on a wrist. Further, no moving mechanical parts such as springs, triggers, or boomerang feeder magazines are present in the device with the exception of the boomerang.

SUMMARY OF THE INVENTION

The invention may be summarized as a toy assembly for retaining and launching a miniature boomerang from an upper limb of the body which limb includes a wrist, hand, and fingers. The assembly consists of the combination of the boomerang, a support member attachable to the upper limb, and a platform mounted on top of the support member to retain the boomerang in a first storage position and further to provide for the shifting of the boomerang to a second launching position wherein a boomerang wing is exposed beyond the periphery of the platform and launching is accomplished by flicking that wing with a finger of the opposite upper limb on which the support member is positioned.

The boomerang is approximately one to two inches in diameter and the entire assembly is easily constructed of a plastic or resin material by molding or produced by a three dimensional printer. The distance of boomerang travel can be three or more feet depending on the force imparted during the launching. Additionally, a decorative motif may be mounted on top of the platform, and the top of the boomerang may be inscribed with patterns to enhance its flight characteristics.

These and other features and attributes of the invention will be more fully understood from the drawings and description of the preferred embodiment that follow.

DESCRIPTION OF THE PREFERRED EMBODIMENT

Figure 1:
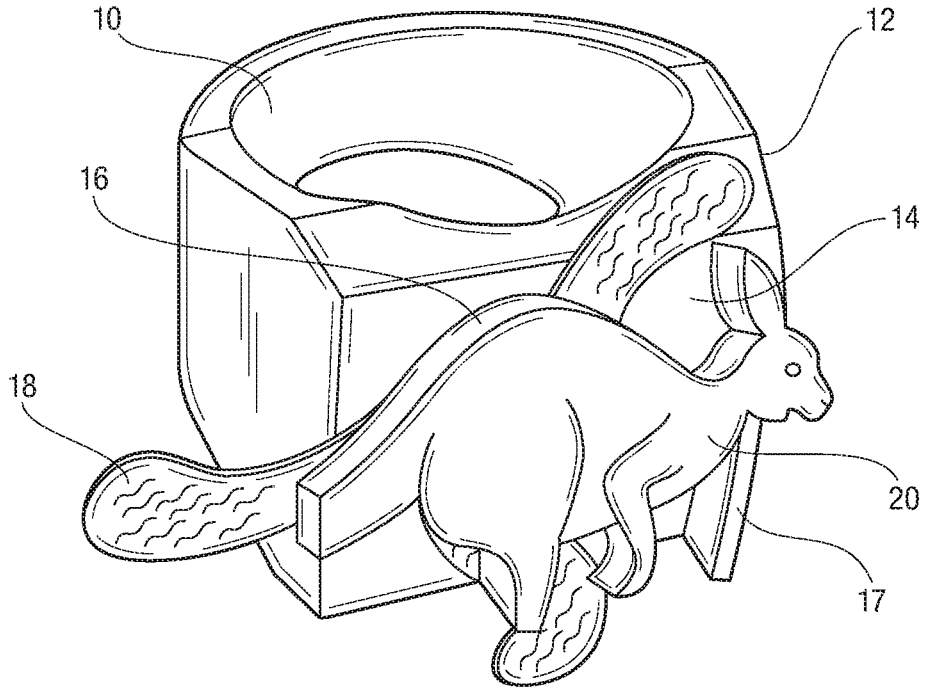
FIG. 1 is a perspective view of a first embodiment of the invention.
Figure 3:
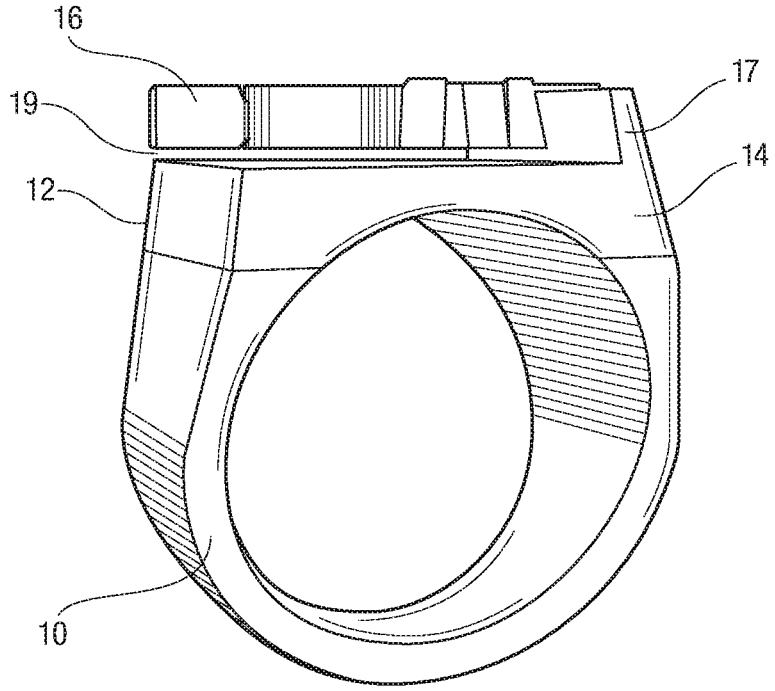
FIG. 3 is a perspective side view of the embodiment of FIG. 1.

FIGS. 1 and 3 illustrate a first preferred embodiment of the invention consisting of a ring member 10 adapted to fit a finger of a hand which ring member supports, on its upper or top side, a boomerang storage and launching platform 12. Platform 12 consists of two spaced apart planer members 14 and 16 mounted or joined one above the other by, for example, wall member 17. The space 19 created between members 14 and 16 is slightly less than the maximum thickness of boomerang 18 and thereby provides a light but secure clamping force for the boomerang in both storage and launch positions. This force can be achieved by constructing the ring of a slightly deformable material such as plastic allowing planer members 14 and 16 to spread apart upon insertion of boomerang 18.

Upper platform member 16 may optionally be configured in a selective shape 20 as shown and additionally may have, for example, a molded raised top surface, graphic images, or engraved lines forming a decorative motif to enhance the appearance of the invention.

Figure 2:
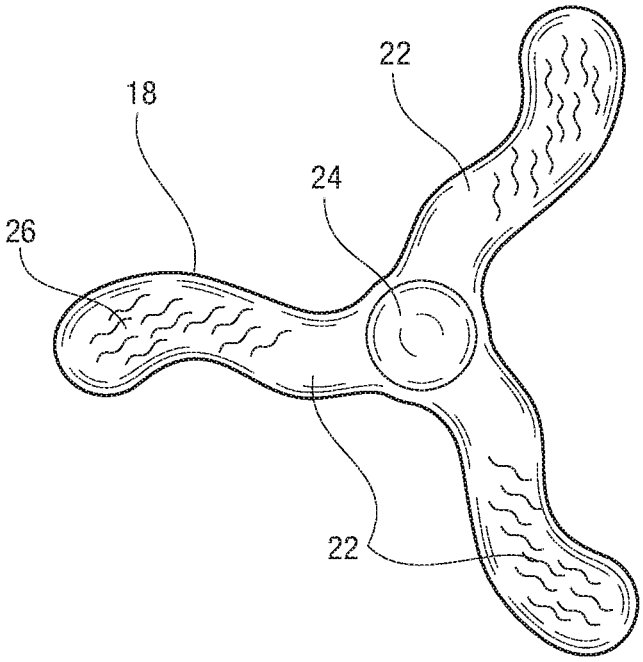
FIG. 2 is a top view of a component of the embodiment of FIG. 1.

A suitable miniature boomerang configuration is shown in FIG. 2 consisting of three equally spaced apart wings 22 connected by a central hub 24. Various patterns 26 may also be inscribed on or molded into a surface of the boomerang for decorative purposes as well as to improve its flight characteristics.

Figure 4:
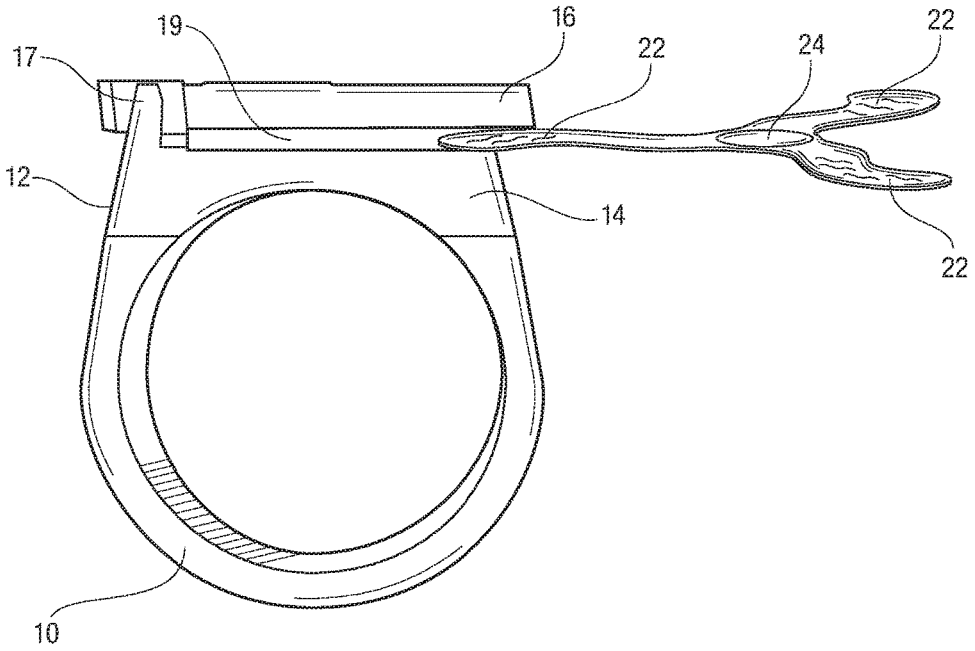
FIG. 4 is an additional side view of the embodiment of FIG. 1.

In FIG. 1, boomerang 18 is shown in a storage position and in FIG. 4 in a launch position. To use the invention, the operator fixes the ring on a selected finger in an upright position, inserts one wing of the boomerang into space 19 where it is held by the light pressure of the spaced apart platform members, and then launches the boomerang with the flick of a finger of the opposite hand against the portion of the boomerang extending outside the platform periphery. If desired, a boomerang may be stored in space 19 beyond the launching position toward wall 17 for carrying and then shifted into the launching position at a future time.

Figure 5:
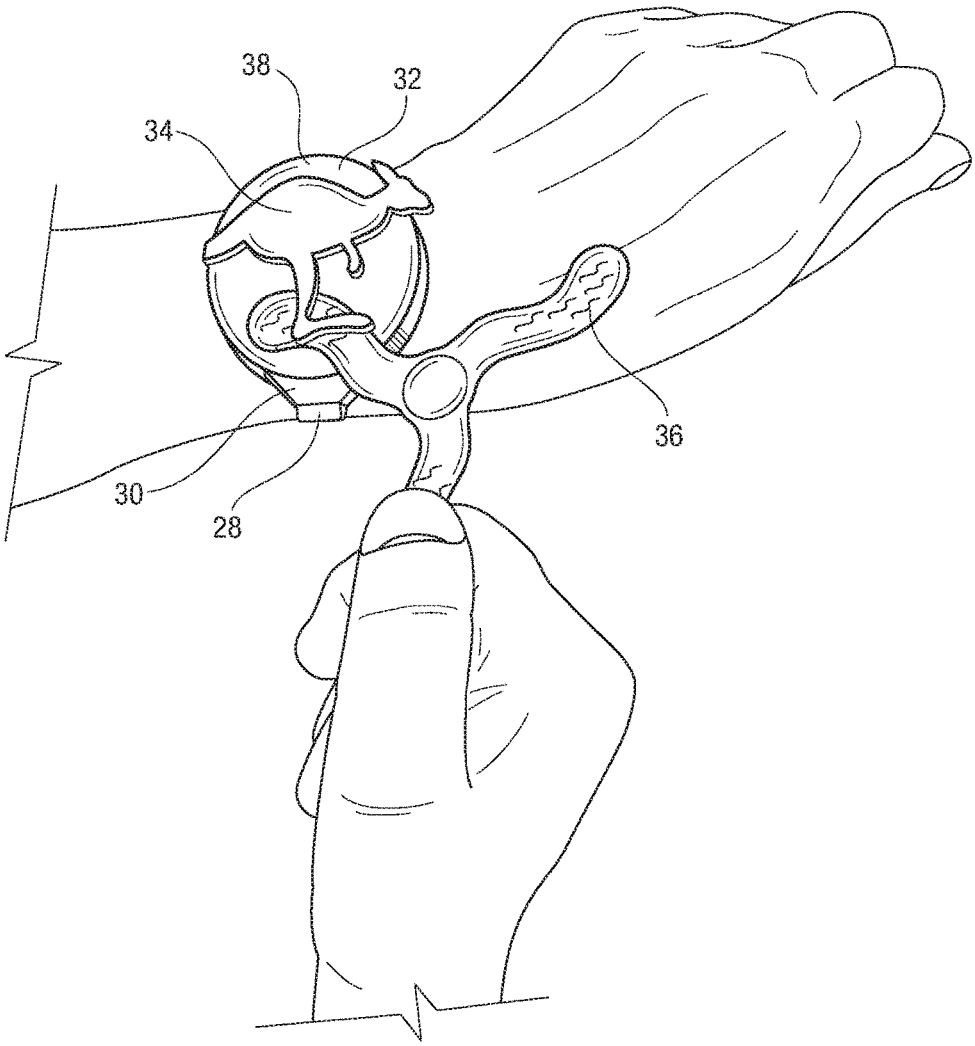
FIG. 5 is a perspective view of an additional embodiment shown in use.
Figure 6:
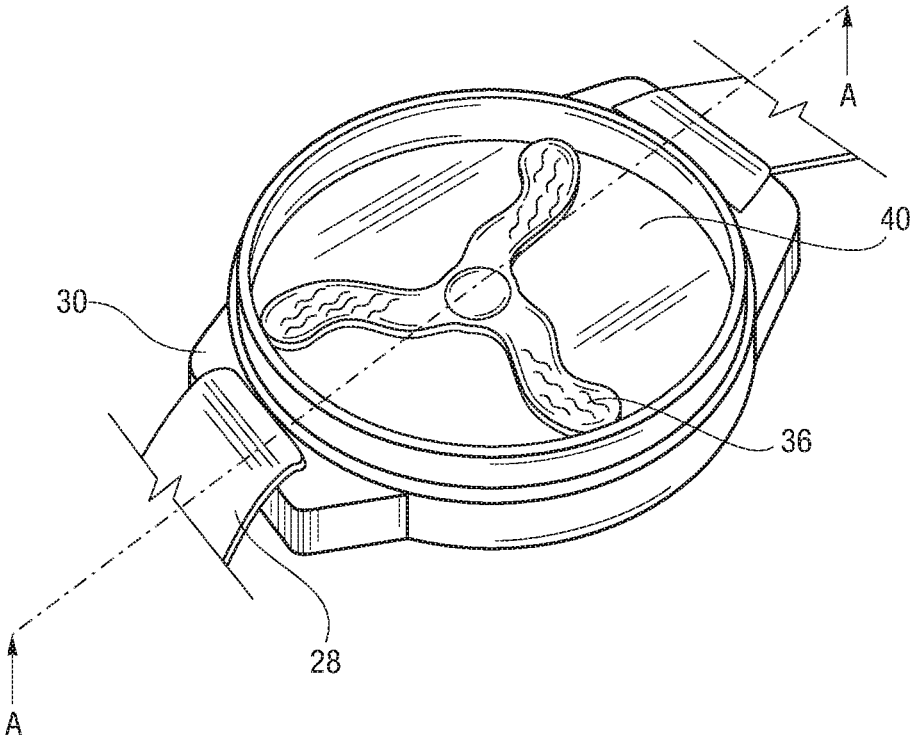
FIG. 6 is a perspective view of a portion of the embodiment of FIG. 5.
Figure 7:
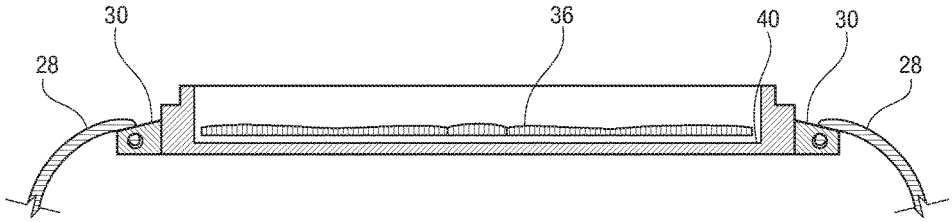
FIG. 7 is a cross-section elevation view of the embodiment of FIGS. 5 and 6 along line A-A.

FIGS. 5 and 6 show an alternative embodiment employing the same structure described above for a ring but adapted to be worn on the wrist of an upper limb. A bracelet or wrist band 28 secures the platform 30 which consists of two spaced apart planar members, 32 and 34, to hold and launch a boomerang 36 disposed between the two planer members. Additionally, as illustrated in FIGS. 5, 6, and 7, the lower planer member 32 may consist of a receptacle composed of a cover 38 and a hollow base 40 into which one or more boomerangs may be placed for storage.

What is claimed is:

1. A toy assembly arranged for retaining and launching a miniature boomerang from the upper side of an upper limb of a human body, said limb including a wrist, a hand, and fingers, said assembly comprising in combination:

A. a miniature boomerang consisting of a central hub and a plurality of spaced apart wing members attached to and extending outwardly from said hub;

B. a platform for retaining said boomerang in a first storage position and for launching said boomerang from a second launching position, spaced apart from said first storage position, by flicking one of said wing members with a finger from the opposite upper limb on which said toy assembly is positioned; and C. a platform support member attachable to the top of said limb, wherein said platform is attached to and positioned on the upper side of said support member.

2. The toy assembly of claim 1 wherein said platform comprises

A. a first planer member attached to said support member upper side; and

B. a second planer member flexibly mounted above and in spaced apart relationship to said first planer member, the distance between said first and second planer members arranged to be less than that of the maximum thickness of said boomerang.

3. The toy assembly of claim 2 wherein said platform support member comprises a finger ring.

4. The toy assembly of claim 2 wherein said platform support member comprises a wrist bracelet.

5. The toy assembly of claim 2 wherein said platform support member comprises a wrist band.

6. The toy assembly of claim 2 further including a decorative motif positioned above said second planer member.

7. The toy assembly of claim 1 wherein said boomerang includes a decorative motif inscribed on the top thereof.

8. The toy assembly of claim 1 further including a boomerang storage container mounted on top of said platform support member.

9. A method of using a toy assembly arranged for retaining and launching a miniature boomerang from the upper side of an upper limb of a human body, said limb including a wrist, a hand, and fingers, said method comprising in combination A. providing a toy assembly comprising i. a miniature boomerang consisting of a central hub and a plurality of spaced apart wing members attached to and extending outwardly from said hub;

ii. a platform for retaining said boomerang in a first storage position and for launching said boomerang from a second launching position spaced apart from said first storage position; and iii. a platform support member attachable to the top of said limb, wherein said platform is attached to and positioned on the upper side of said support member and wherein said platform comprises a. a first planer member attached to said support member upper side; and b. a second planer member flexibly mounted above and in spaced apart relationship to said first planer member, the distance between said first and second planer members arranged to be less than that of the maximum thickness of said boomerang;

B. inserting said boomerang into said launching position of said platform between said first and second planer members wherein at least one of said wing members and said hub extend beyond the periphery of said planer members; and C. launching said boomerang by flicking one of said wing members with a finger from the opposite upper limb on which said toy assembly is positioned.

10. The method of using a toy assembly of claim 9 further including the step of inserting said boomerang into said storage position of said platform between said first and second planer members prior to launching said boomerang.

* * * * *